US009920501B2

(12) United States Patent
Paull

(10) Patent No.: US 9,920,501 B2
(45) Date of Patent: Mar. 20, 2018

(54) APPARATUS AND METHOD FOR ENHANCED GRADING CONTROL

(71) Applicant: Philip Paull, Noblesville, IN (US)

(72) Inventor: Philip Paull, Noblesville, IN (US)

( * ) Notice: Subject to any disclaimer, the term of this patent is extended or adjusted under 35 U.S.C. 154(b) by 0 days.

(21) Appl. No.: 15/228,030

(22) Filed: Aug. 4, 2016

(65) Prior Publication Data

US 2018/0044880 A1 Feb. 15, 2018

Related U.S. Application Data

(60) Provisional application No. 62/201,124, filed on Aug. 5, 2015.

(51) Int. Cl.

| | |
|---|---|
| ***A01B 29/06*** | (2006.01) |
| ***E02F 3/84*** | (2006.01) |
| ***E02F 3/76*** | (2006.01) |

(52) U.S. Cl.
CPC ..... *E02F 3/845* (2013.01); *E02F 3/7677* (2013.01)

(58) Field of Classification Search
CPC ..... E02F 3/845; E02F 3/7677; E02F 3/7695; E02F 3/6481; A01B 29/06; A63B 21/0615; E01C 19/26
See application file for complete search history.

(56) References Cited

U.S. PATENT DOCUMENTS

| | | | | | |
|---|---|---|---|---|---|
| 2,109,749 | A * | 3/1938 | McColl | B31B 1/74 | 138/109 |
| 2,508,080 | A * | 5/1950 | Stumpf | E02F 3/7695 | 37/381 |
| 3,815,686 | A * | 6/1974 | Ryan | E02F 3/765 | 172/763 |
| 4,307,522 | A * | 12/1981 | Colville | E02F 3/6481 | 37/414 |
| 6,068,065 | A * | 5/2000 | Mehew | A01B 29/06 | 172/171 |
| 6,132,343 | A * | 10/2000 | Eze | A63B 21/0615 | 482/97 |
| 7,497,642 | B2 * | 3/2009 | Raymond | E01C 19/26 | 404/117 |
| 7,999,392 | B2 * | 8/2011 | Ohtake | H01L 21/76808 | 174/261 |
| 2008/0310918 | A1 * | 12/2008 | Raymond | E01C 19/26 | 404/122 |

* cited by examiner

*Primary Examiner* — McDieunel Marc
(74) *Attorney, Agent, or Firm* — C. John Brannon; Brannon Sowers & Cracraft PC

(57) ABSTRACT

A rollered grading assembly, including an elongated roller drum, an axle extending through the drum, an elongated housing partially enclosing the drum and connected to the axle, an elongated blade connected to the housing, a pivot rod perpendicular to the axle and connected to the housing, a coupler connected to the housing, and a pivot actuator connected to the coupler and housing. The coupler has a proximal end connected to the housing portion and positioned adjacent the roller drum and a spaced distal end extending away from the housing. Movement of the distal end a first distance while the proximal end remains stationary urges the housing to pivot around the drum and move the blade portion a second, shorter distance into a desired position relative grade.

11 Claims, 13 Drawing Sheets

APPARATUS AND METHOD FOR ENHANCED GRADING CONTROL

CROSS-REFERENCE TO RELATED APPLICATIONS

This patent application claims priority to U.S. Provisional Patent Application Ser. No. 62/201,124, filed on Aug. 5, 2015, all of which is incorporated herein by reference.

TECHNICAL FIELD

The present novel technology relates generally to the field of mechanical engineering, and, more particularly, to a method and apparatus for enhancing grading capabilities of a grading and digging machine.

BACKGROUND

Keeping on grade while grading with a back hoe and screed continues to be a challenge even for the most experienced operators. More so than most digging machines, the extended lever arm of the hoe combined with the downward digging forces applied produce unwanted wiggling and vibration of the hoe arm and screed blade. Even experienced operators, having developed a tactile 'feel' for how well the screed is digging and cutting, have difficulty maintaining grade, and the more precisely the grade must be maintained, the more difficult and draining the job. While very good operators are able to maintain grade reasonably well even over prolonged digging sessions, the effort does take its toll both physically and mentally.

Conventional laser alignment and even GPS-guided devices have been developed to give the operator more reliable feedback regarding how close the grading screed is to the desired grade. Such devices provide feedback to the operator that the blade is too high, too low, or on grade at any given time during the digging operation. However, the operator must still receive and manually respond to the feedback signals (i.e., up or down) provided by the devices. Such constant correction of the bucket depth has proven to be physically demanding and exhausting.

Thus, there is a need for a system for automatically assisting grading and for automatically keeping the excavation on a predetermined grade. The present novel technology addresses this need.

DETAILED DESCRIPTION

Figure 1:
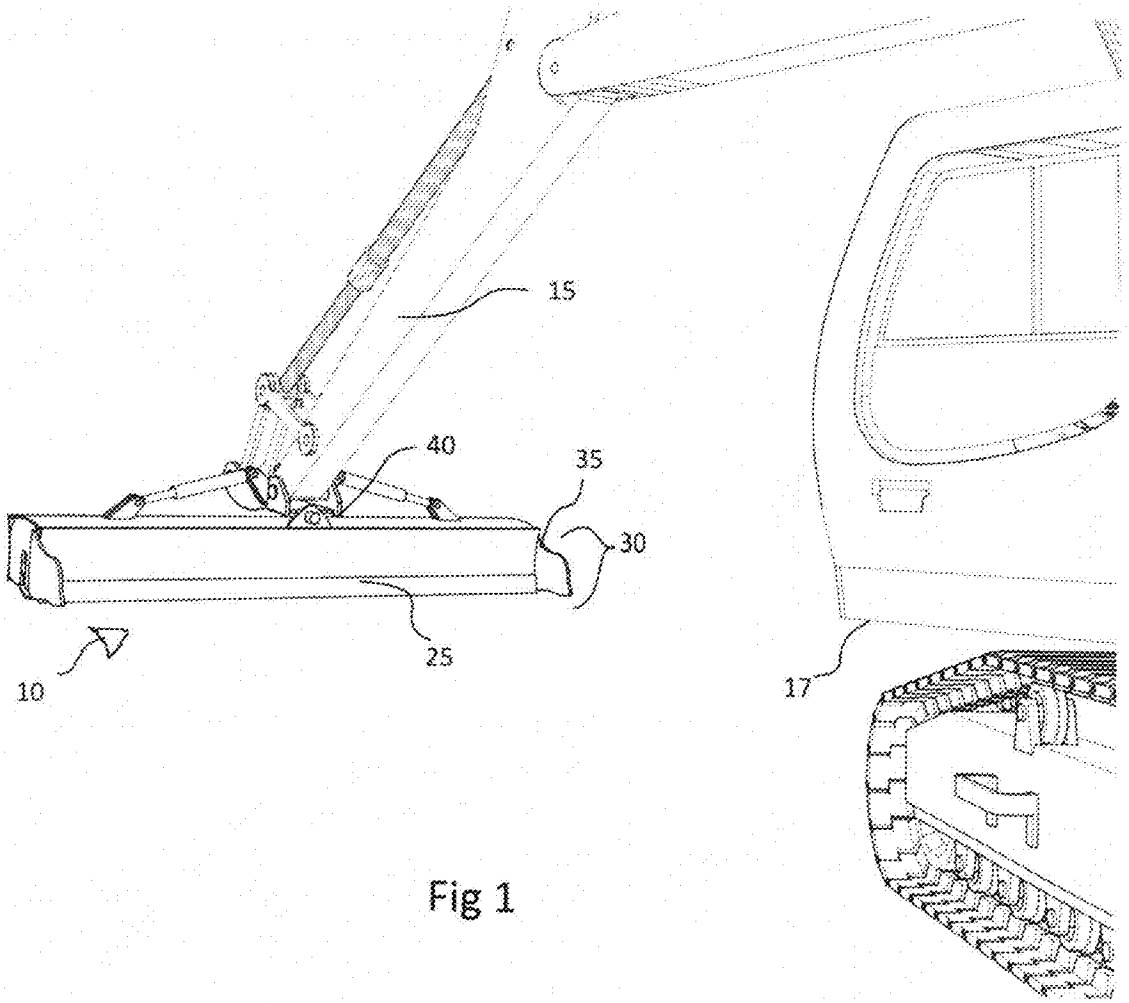
FIG. 1 is a first perspective view of a rollered grader attachment defining a first embodiment of the present novel technology.
Figure 2:
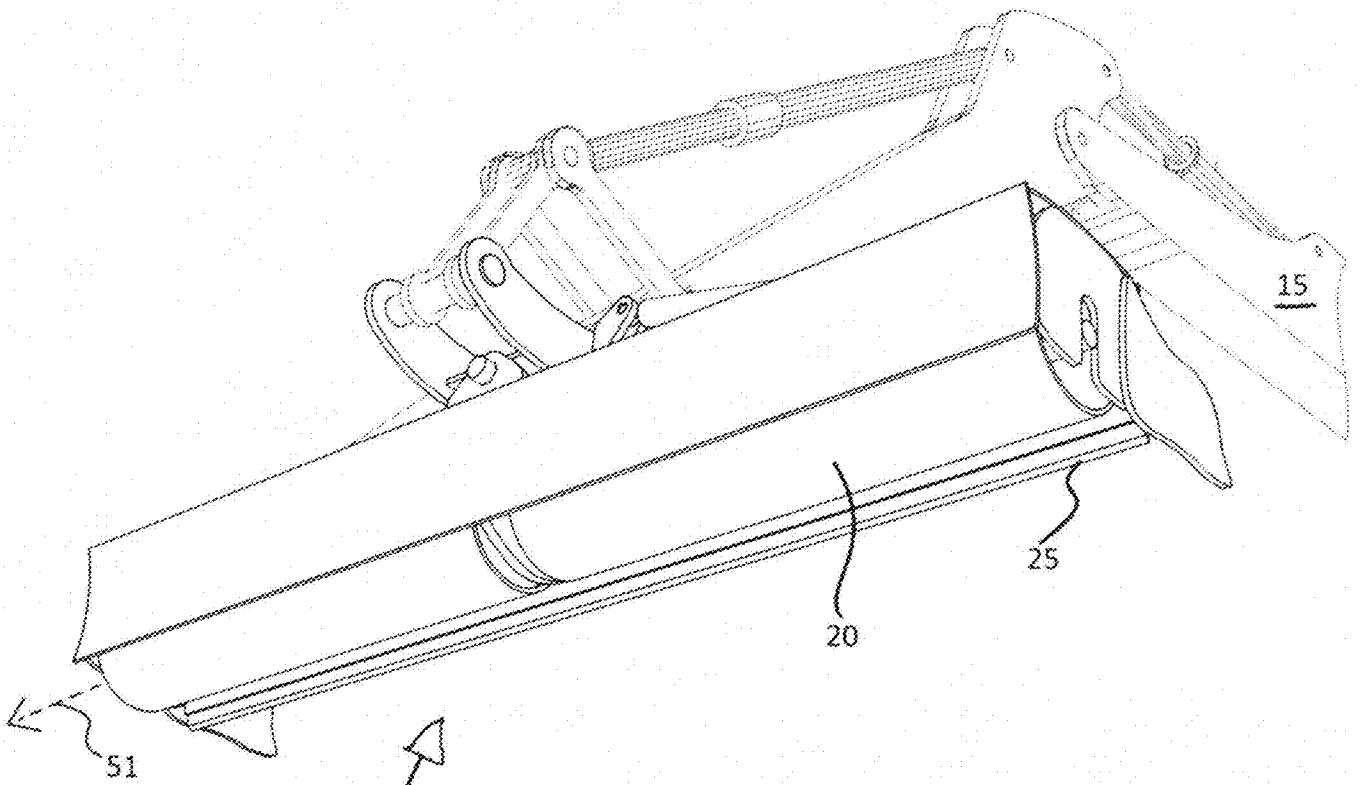
FIG. 2 is a second perspective view of the rollered grader attachment of FIG. 1.
Figure 3:
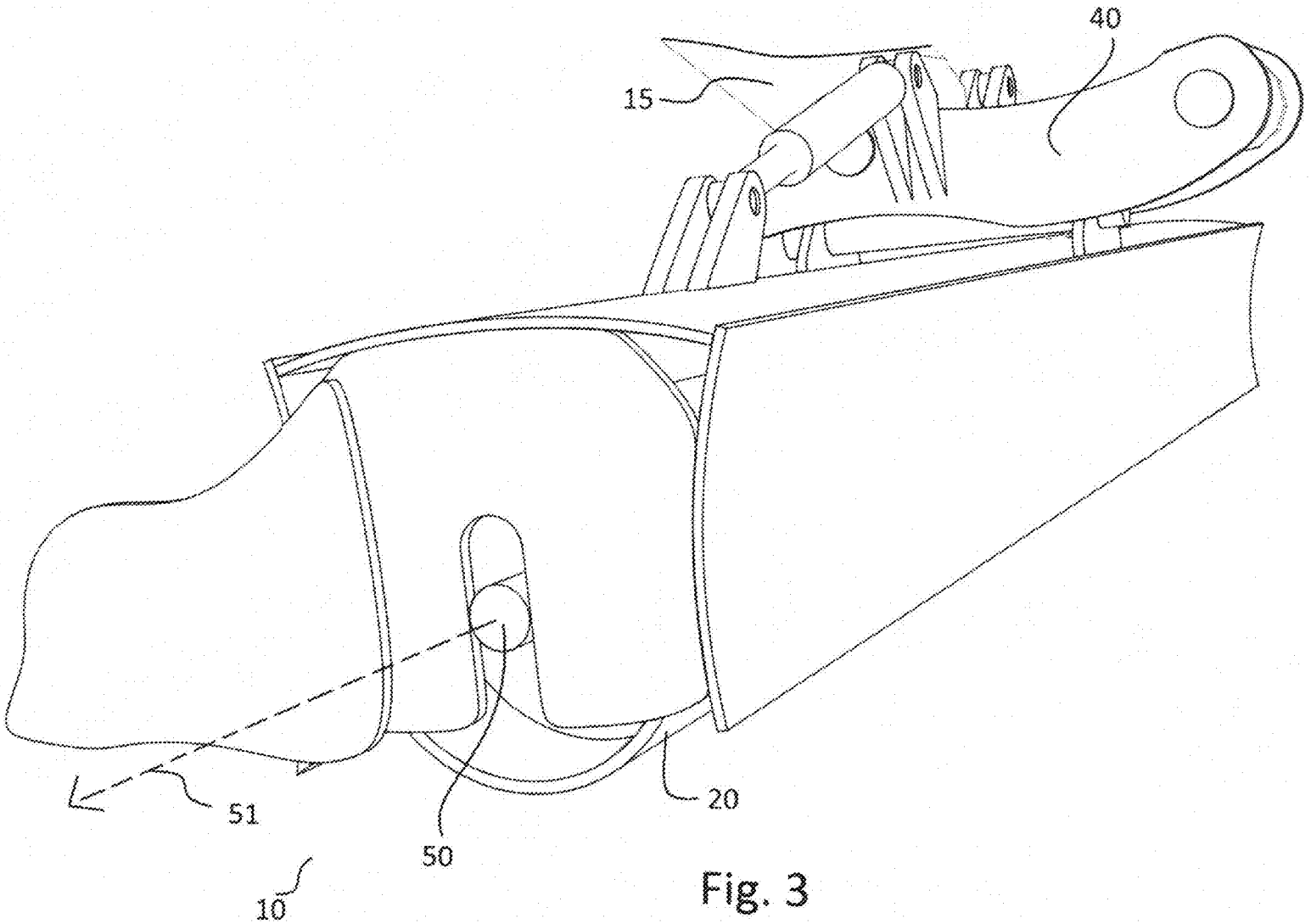
FIG. 3 is a third perspective view of the rollered grader attachment of FIG. 1.
Figure 4:
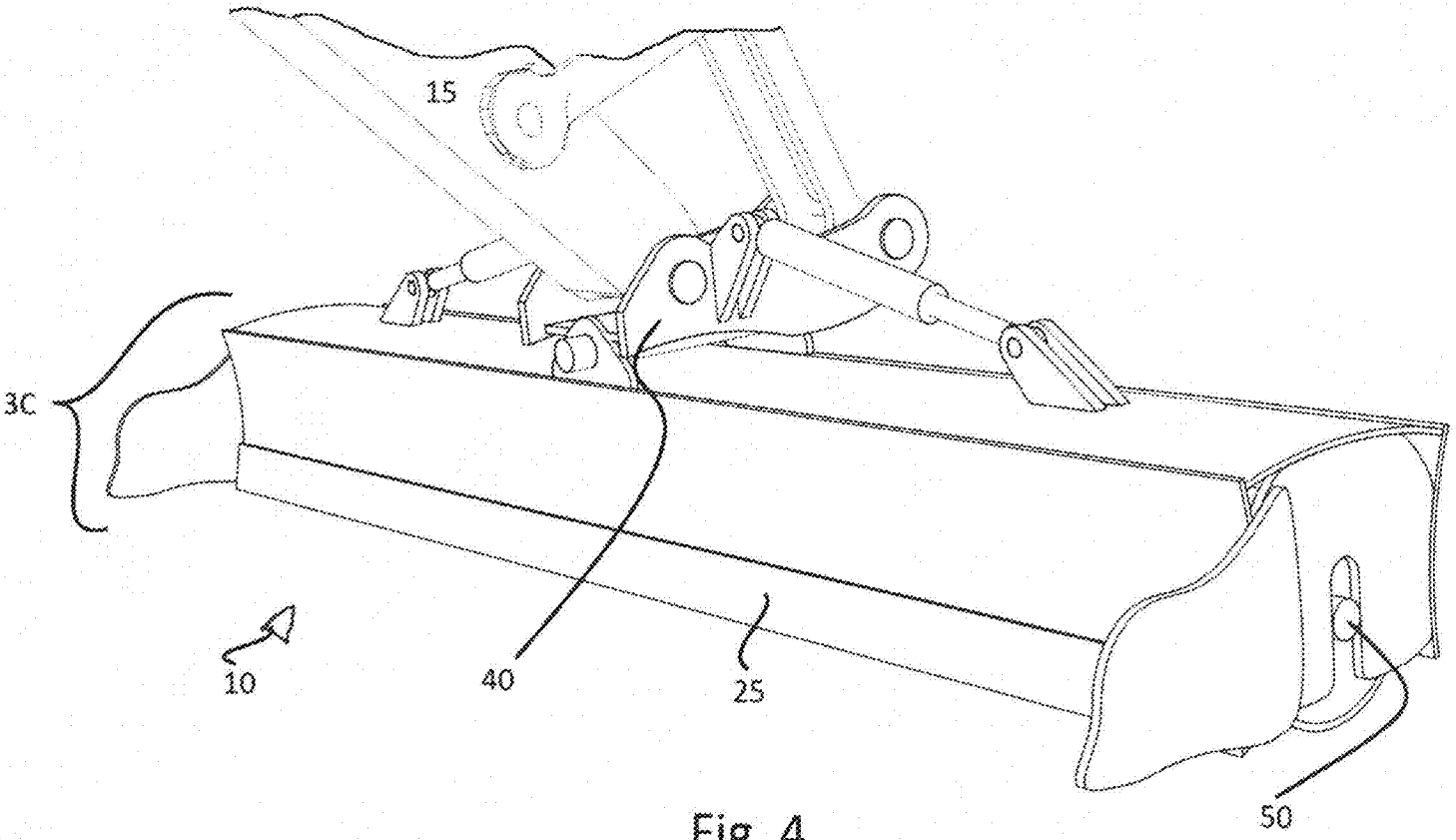
FIG. 4 is a fourth perspective view of the rollered grader attachment of FIG. 1.
Figure 5:
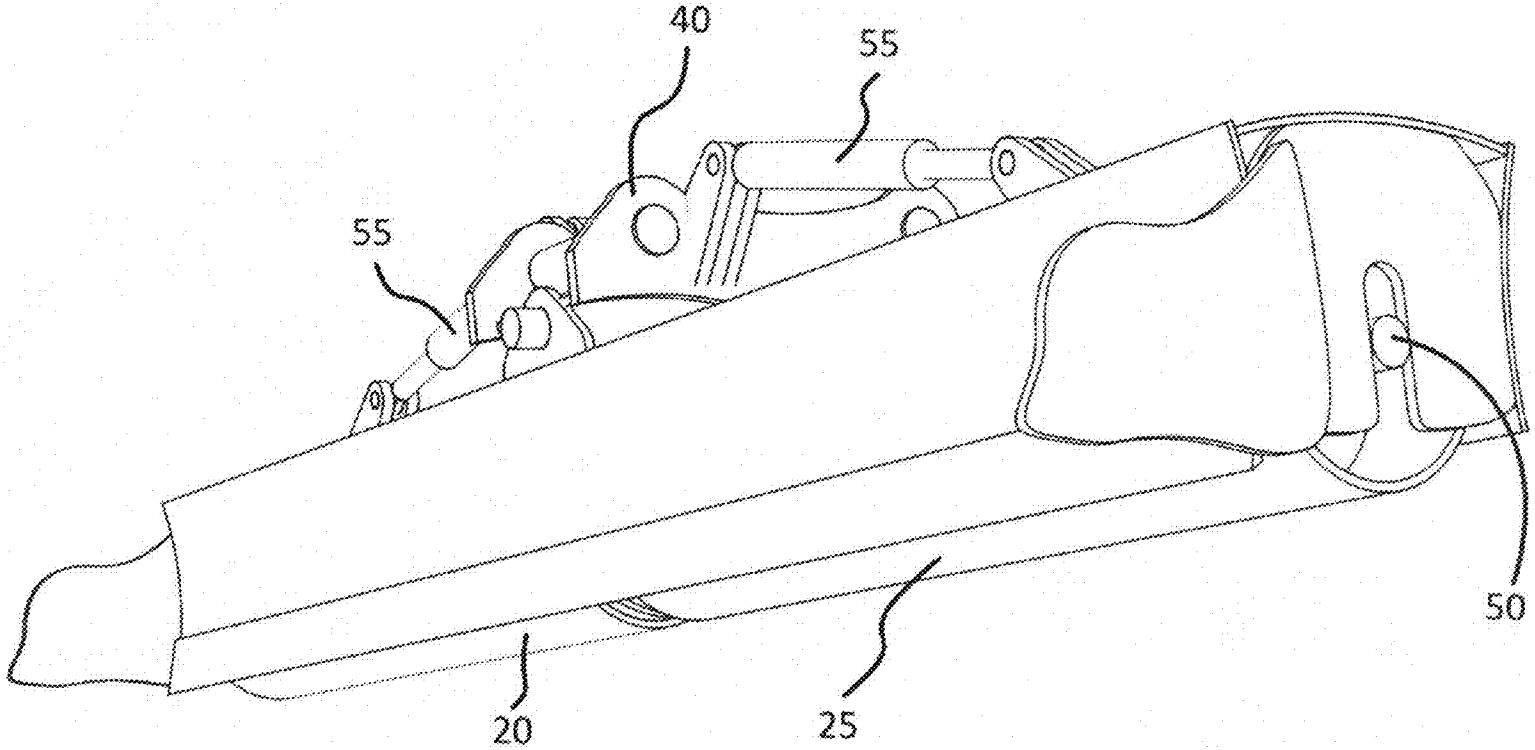
FIG. 5 is a fifth perspective view of the rollered grader attachment of FIG. 1.
Figure 6:
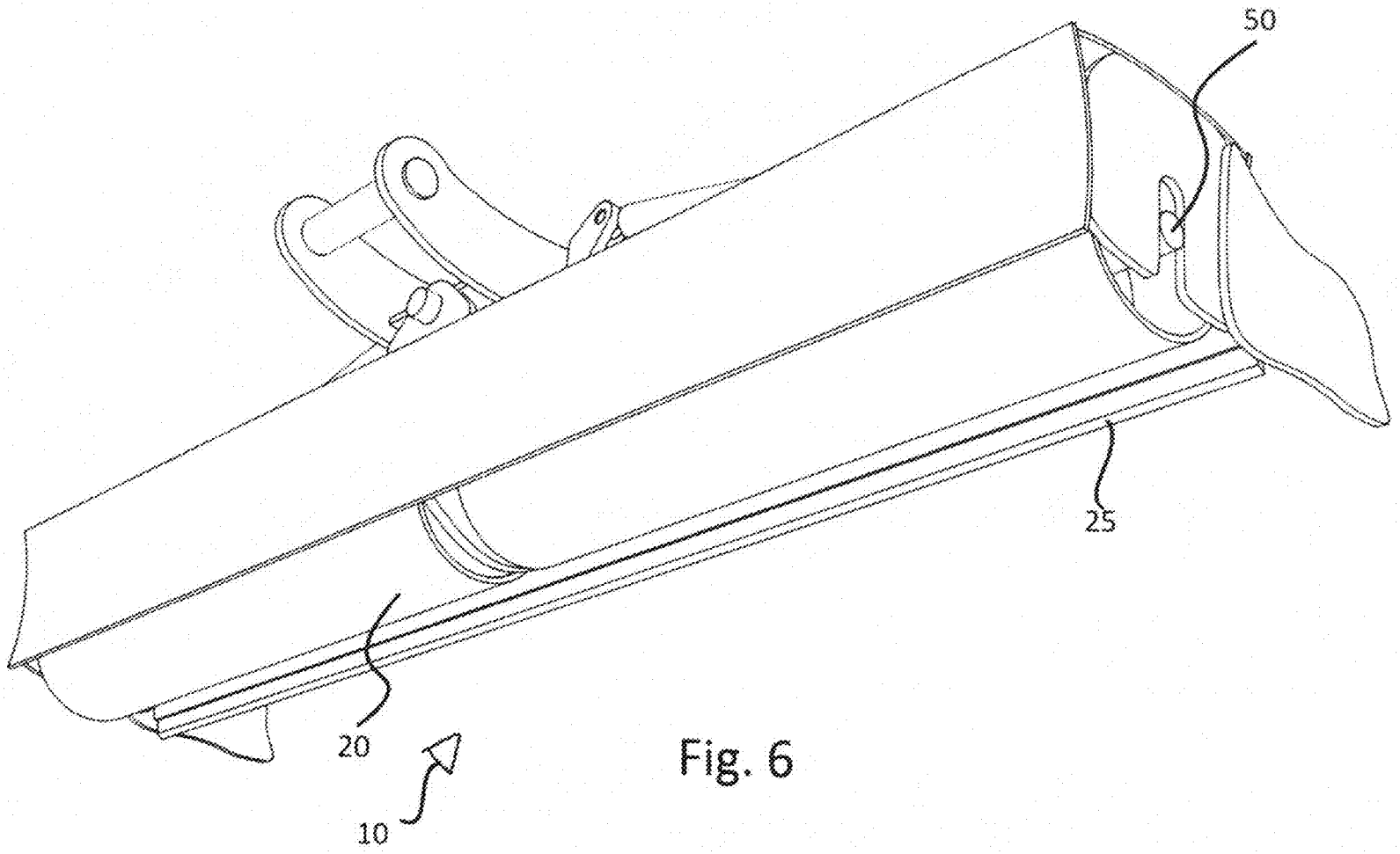
FIG. 6 is a sixth perspective view of the embodiment of FIG. 1.
Figure 7:
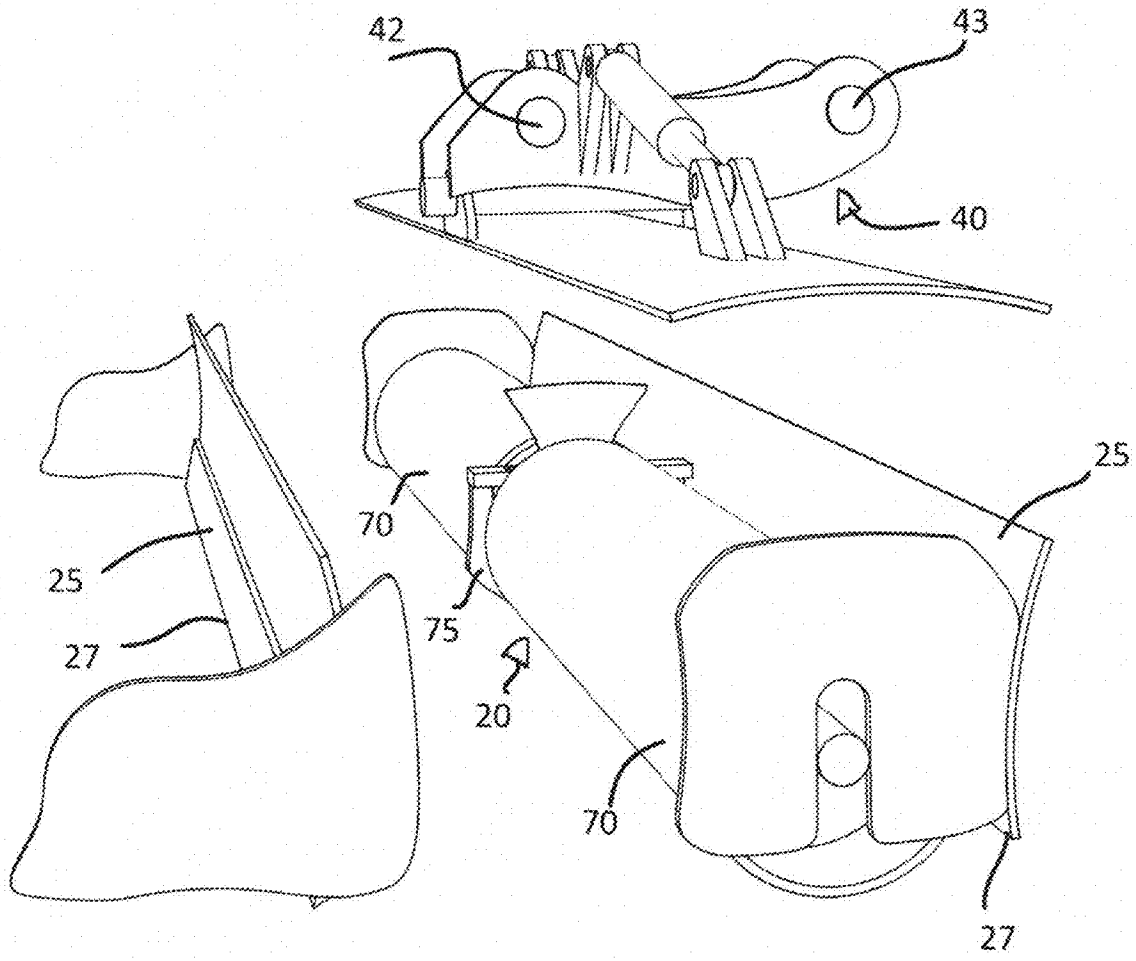
FIG. 7 is a first exploded view of the embodiment of FIG. 1.
Figure 8:
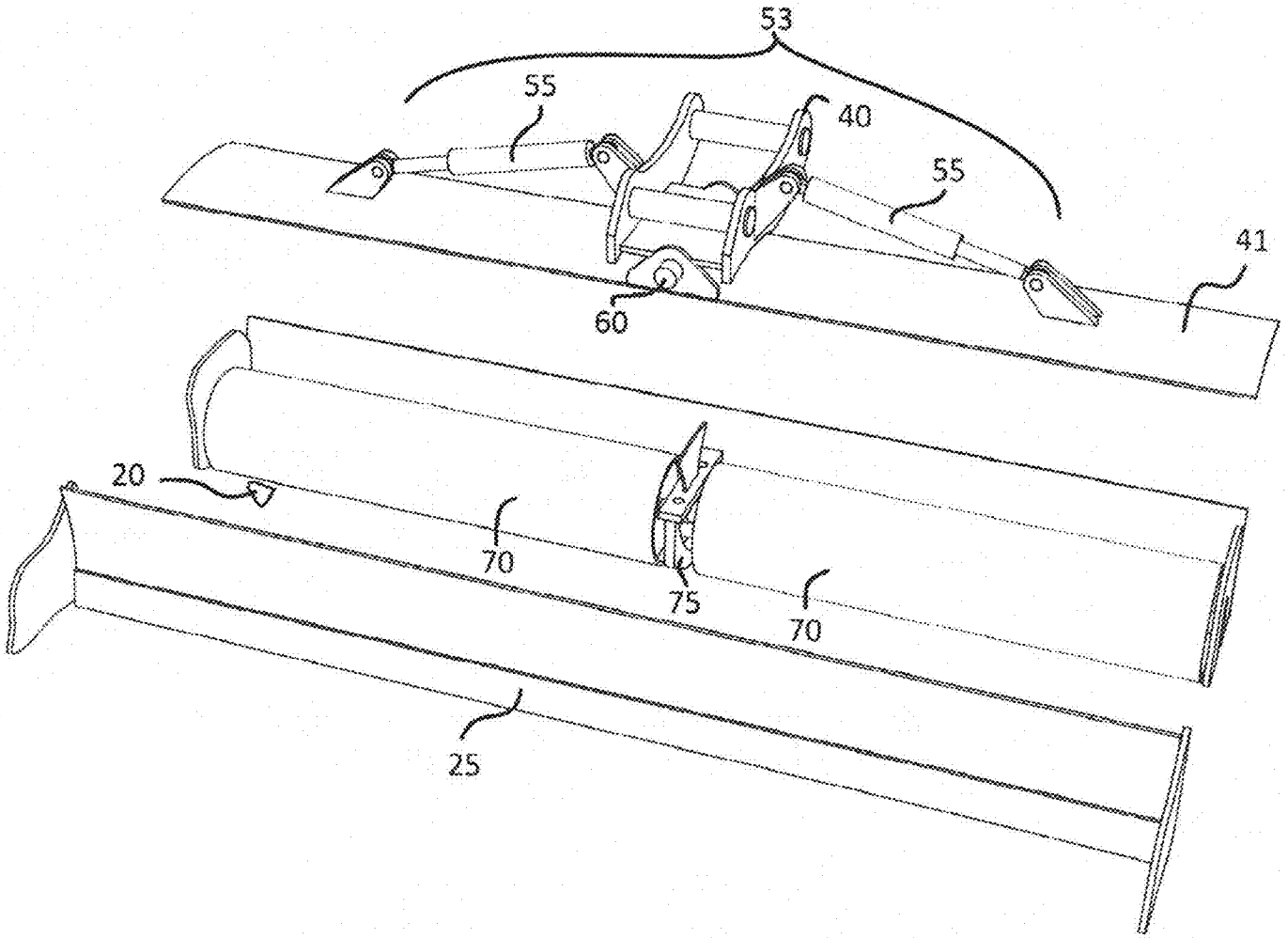
FIG. 8 is a second exploded view of the embodiment of FIG. 1.
Figure 9:
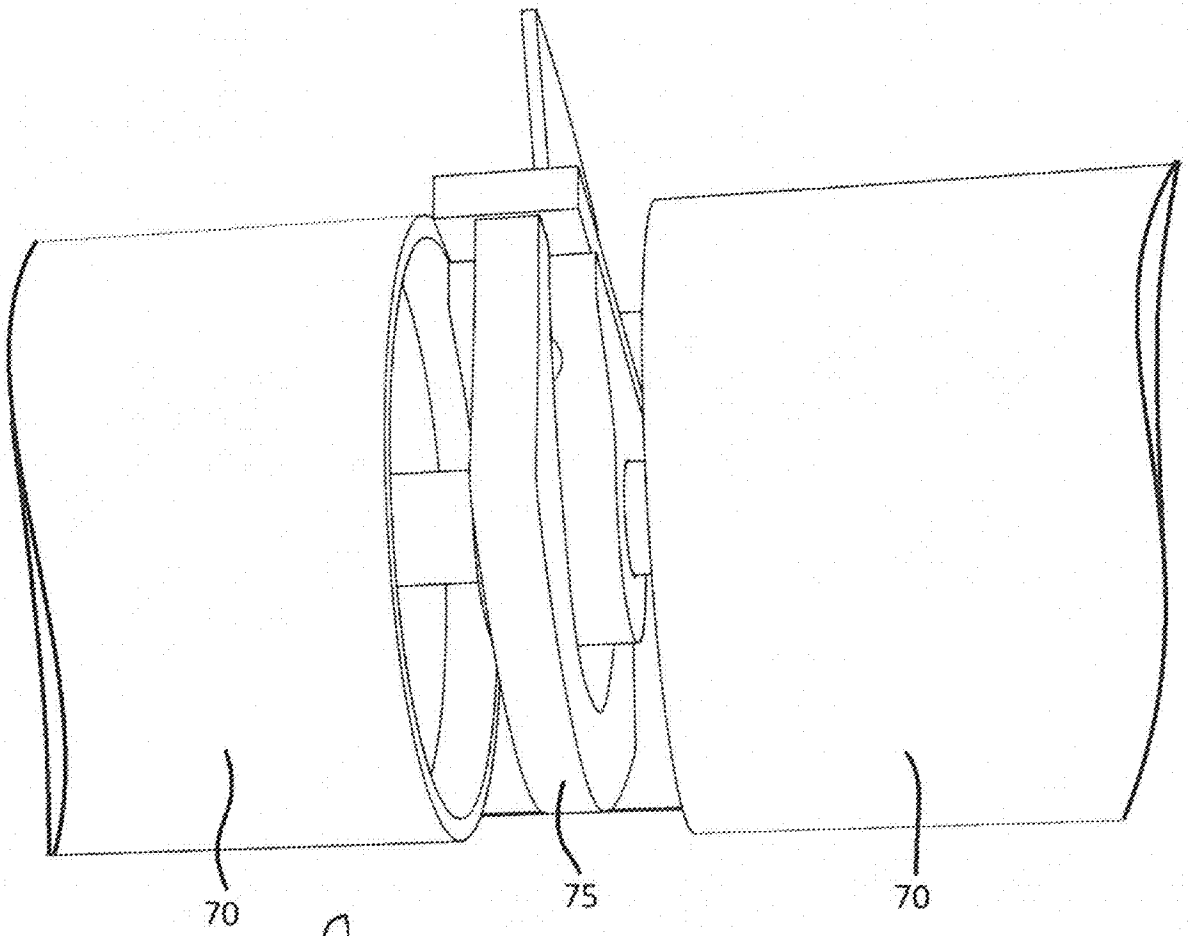
FIG. 9 is an enlarged partial perspective view of the dual roller portion of FIG. 1.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

A first embodiment of the present novel technology is illustrated in FIGS. 1-9, a rollered elongated dozer blade or screed assembly 10 for precision grading as connected to an elongated member 15 such as a track hoe boom, back hoe boom, loader armature or the like. The elongated member 15 is typically operationally connected to a tractor 17 or like digging machine system 100. The assembly 10 includes an elongated roller 20 positioned adjacent to an elongated blade 25 and rotatably connected to a housing 30, of which the blade 25 may be part. The housing 30 typically includes a pair of oppositely disposed spaced sidewall members 35 between which the blade 25 may extend and to which the roller member 20 may be rotatably connected. The housing 30 also typically includes a connector 40 to which a boom armature 15 may be operationally connected, with the connector 40 typically engaged to an elongated topwall member 41 extending between the sidewall members 35 and to which at least one blade 25 member may be connected. While the following example and drawings focus on a rollered elongated blade assembly 10, the claimed novel technology is not limited to the blade assembly 10 and includes control of the same with automated digging machine systems 100, such as those including position sensors 115 and/or depth sensors 120 operationally connected to a microprocessor 125 and likewise connected in communication with a reference signal 130. The sensors 115, 120 may be separate or they may both be into the same device or devices (such as a GPS transceiver). Further, some embodiments may only have depth sensors 120, while others may only have position sensors 115. The reference signal 130 may be from a GPS satellite, a laser, and/or the like.

FIGS. 1-9 illustrate the above system with a rollered grading attachment 10 connected to a boom arm 15. The attachment has a front blade portion 25 for cutting and levelling earth, and an elongated roller portion 20 positioned adjacent and behind the blade portion 25. Blade and roller portions 25, 20 are connected to a support housing 30, which is in turn connected to boom arm 15, typically via coupler 40. Housing 30 also typically includes a top pivot rod 45 operationally connected through the coupler 40, such that the boom arm 15 may be maneuvered to pivot about the roller 20. By controlling the angles of the triangle defined by the pivot rod 45, the elongated roller 20 and the blade 25, an operator and/or the system 10 may control grading as the blade 25 is moved across the earth, either by retraction of the boom arm 15, moving the entire system 10, 100 (i.e., moving the hoe or dozer tractor 17), or a combination of both. The roller 20 is typically connected to the housing 30 via a central axle 50 passing therethrough defining a major axis 51 and rotationally connected to the housing 30.

A tilt urging mechanism 53 is operationally connected to the housing 30, which typically includes at least one hydraulic cylinder 55, and more typically two oppositely disposed cylinders 55, operationally connected to the coupler 40 and extending generally parallel the major axis to connect to the housing 30, more typically to the elongated topwall member 41. The coupler 40 is pivotably connected to a pivot rod 60 operationally connected to the housing 30 and disposed generally perpendicularly to the major axis 51. The coupler 40 typically has an anterior or proximal connection rod or end 42 connected to the housing 30 and positioned adjacent the roller drum 20 and a spaced, parallel posterior or distal connection rod or end 43 extending away from the housing 30 to facilitate the pivoting of whatever tool is connected thereto.

The roller 20 typically includes two shorter roller drums 70 connected by a bearing 75 positioned in the housing generally immediately under the pivot rod 60, although the roller 20 may optionally be a contiguous elongated drum.

In the prior art, a screed blade is raised or lowered by raising or lowering the boom arm to which the blade is connected. In contrast, blade 20 is engaged with the ground by pivoting the housing 30 around the roller drum 20, typically in a direction towards the tractor 17 to which it is engaged. The housing 30 is pivoted around the roller drum 20 by raising the posterior or distal rod or end 43 while keeping the proximate or anterior rod or end 42 stationary. Thus, the posterior rod 43 and posterior end of the coupler 40 traverse a greater distance than does the leading edge 27 of the blade 25, allowing for greater control of the blade 25 by the operator or operating system. Movement or position sensors connected to the system 10 are thus afforded greater resolution and allow for greater precision in control of the positioning of the blade 25. The posterior rod 43 and posterior end of the coupler 40 typically traverse a distance at least two times greater than the distance traversed by the leading edge 27 of the blade 25, more typically at least four times greater, and still more typically at least ten times greater.

If the system 100 is automated, the microprocessor 125 is also typically connected to an actuator assembly 137. The actuator assembly typically 137 includes a pressure source or pump 140, such as a hydraulic or pneumatic pump 140 connected in fluidic communication with at least one hydraulic or pneumatic cylinder 145. The fluidic cylinder 145 is fixedly, and typically pivotably, connected to the assembly 10 or to a hoe or shovel bucket 150 having a cutting edge or teeth 153. While actuator assembly 137 is described herein as being of the pressurized piston/cylinder type, actuator assembly 137 may likewise include other types of actuators, such as mechanical, electromechanical, and/or the like.

Figure 10:
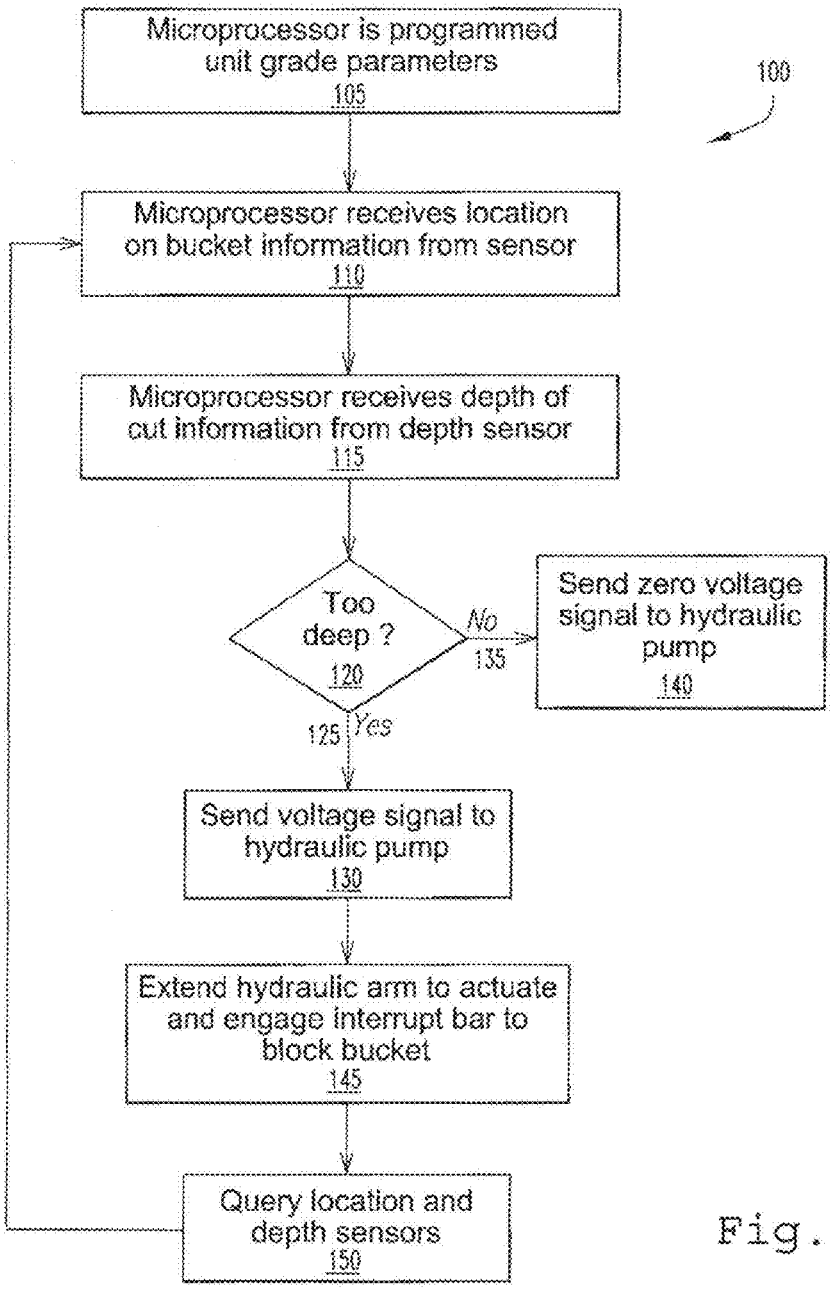
FIG. 10 is a schematic chart following the operation of an automatic grading system.

In operation 100, as schematically illustrated in FIG. 10, microprocessor 125 is first programmed with the location and depth parameters of the grade or excavation to be dug 205. The reference signal 130 is received 210 by the depth sensor 120 and/or microprocessor 125 when the digging machine is in operation, and the position of the assembly 10 and/or blade 25 is calculated in substantially real-time. The location of the assembly 10 is also typically calculated from information supplied by one or more location sensors 115 and received 215 by the microprocessor 125. The position sensor 115 is also be used to calculate the orientation of the assembly 10, in particular the blade 25, such as its degree of pivot relative to a predetermined base orientation, such as blade down and parallel to the horizontal. The depth, location, and orientation information are used to calculate the position of the blade 25 and this is compared 220 by the microprocessor 125 to the programmed grade information. If the blade 25 begins to exceed 225 programmed grade parameters, such as moving deeper than the programmed grade, an actuation signal 230, typically a voltage, is generated by the microprocessor 125 and sent to the hydraulic pump 140, energizing the pump 140 and actuating the cylinder 145 to extend 245 and pivot blade 25 into position to engage the ground ahead of the blade 25. The microprocessor 125 may likewise combine vertical, horizontal, and/or blade orientation parameters to govern the grading of curved and/or complex shape surfaces.

In other embodiments, the grade predetermination function of the microprocessor 125 may be replaced by a mechanical grade indicator, such as a string, line, and/or surface, and the microprocessor voltage or signal generation function may be replaced mechanically, such as by a contact switch or control armature or member.

Figure 11:
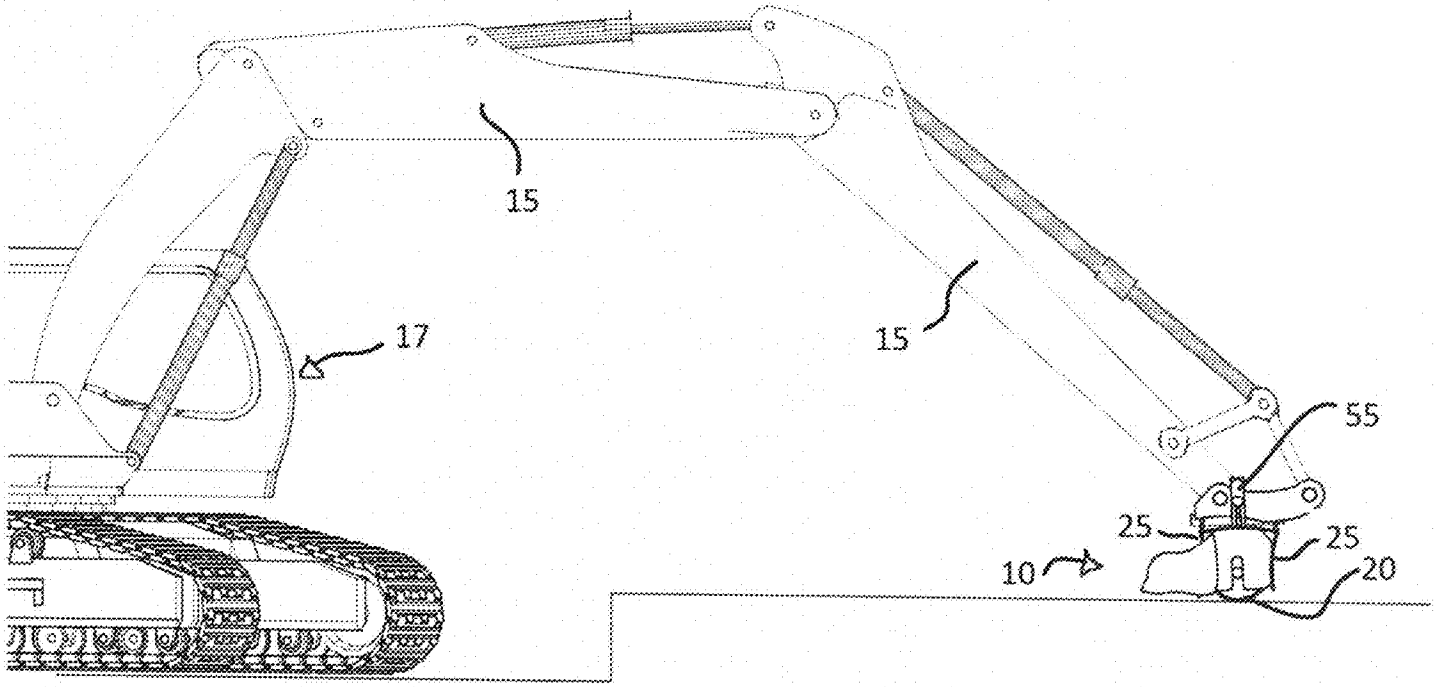
FIG. 11 is a perspective view of the embodiment of FIG. 1 as engaged to a back hoe.
Figure 12:
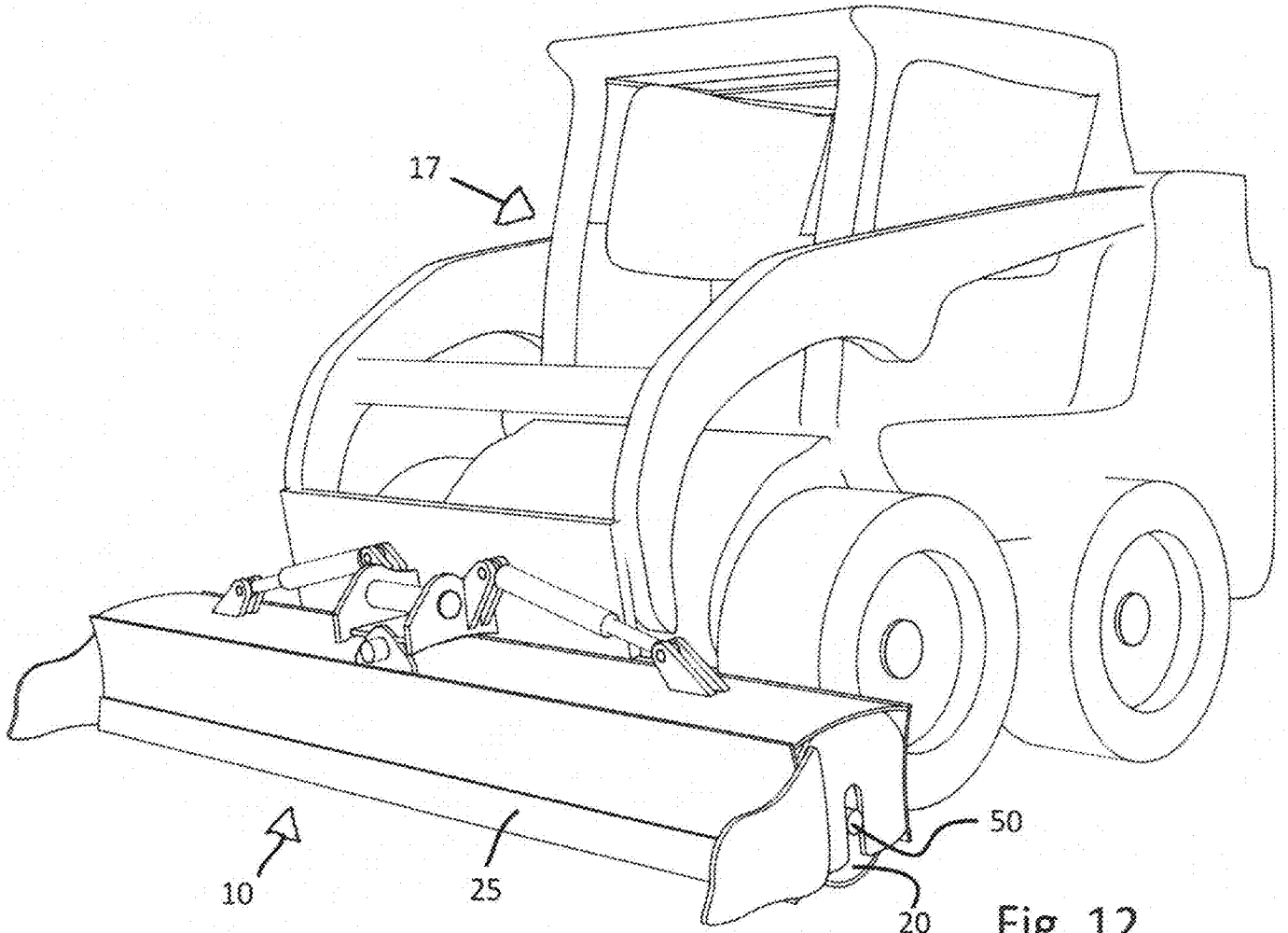
FIG. 12 is a first perspective view of the rollered grader attachment of FIG. 1 with a loader.
Figure 13:
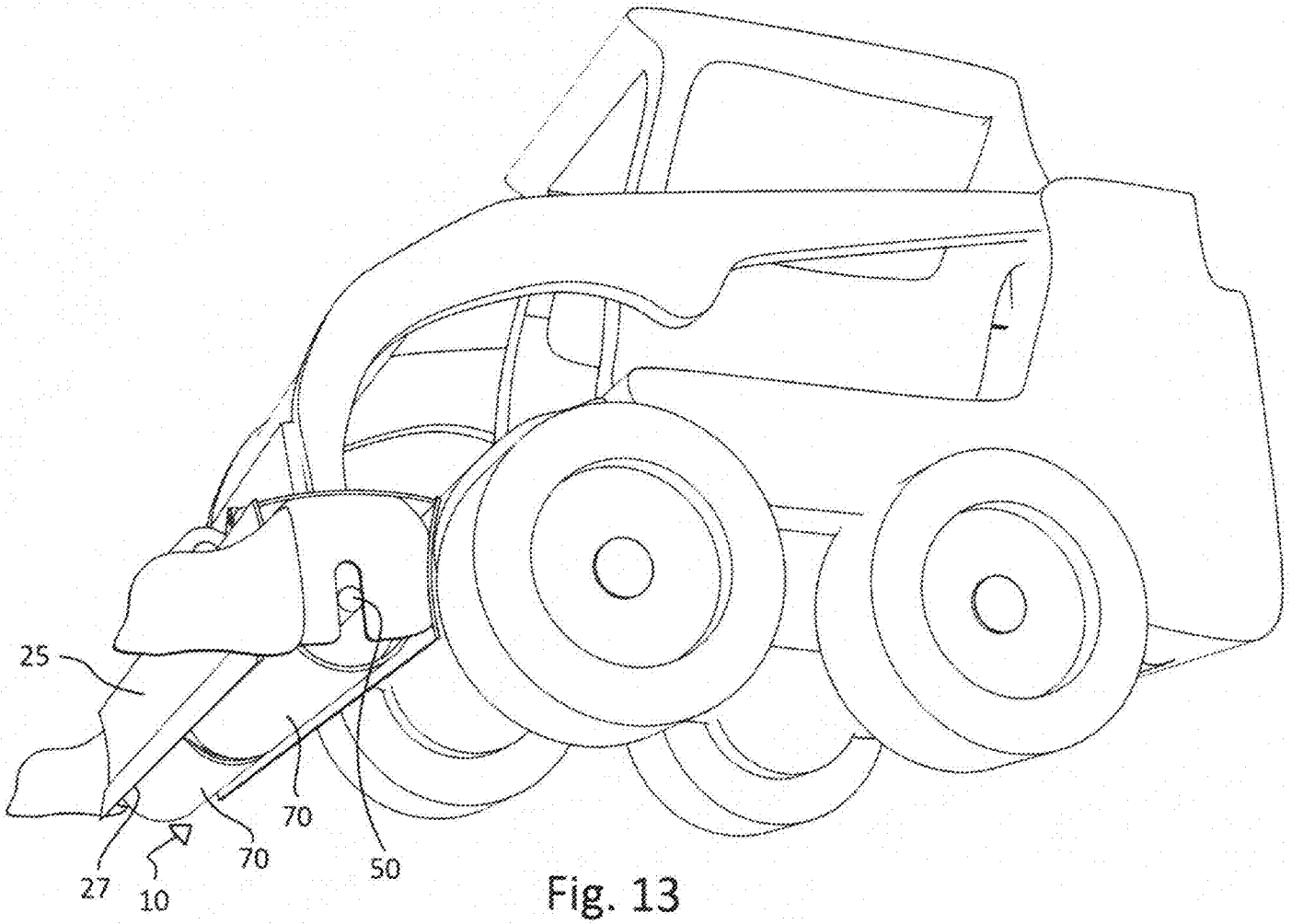
FIG. 13 is a second perspective view of the rollered grader attachment of FIG. 1 with a loader.

FIG. 11 depicts another embodiment of the present novel technology, a semi-automatic digging system 300. The system 400 includes a hoe armature assembly 405 defining a first armature member 410 pivotably connected to a tractor chassis 415, a second armature member 420 pivotably connected to the first armature member 410, a third armature member 425 pivotably connected to the second armature member 420, and a blade assembly 10 pivotably connected to the third armature member 425. A boom piston 435 (boom cylinder, boom hydraulic cylinder, boom hydraulic piston, or, in this case, a first hydraulic actuator) is operationally connected to the chassis 415 and the first armature member 410, a stick piston 440 (stick cylinder, stick hydraulic cylinder, or, in this case, a second hydraulic actuator) is operationally connected to the first and second armature members 410, 420, and a blade piston 445 (blade hydraulic cylinder, blade hydraulic piston, pivot valve, pivot cylinder, or, in this case, a third hydraulic actuator) is operationally connected to the second and third armature members 420, 425. The hydraulic actuators 435, 440, 445 are operationally connected to a hydraulic fluid source (not shown) via hydraulic lines 450.

A valve 460 is operationally connected to the hydraulic lines 450 so as to provide power to the hydraulic actuators 435, 440, 445 and control over the blade 25. Sensors 465 are operationally connected to an electronic controller 470 and are positioned on the members 410, 420, 425 to yield information regarding the position and motion of predetermined points on the members 410, 420, 425 from which the position, orientation, and/or motion of the blade 25 may be determined. The electronic controller 470 is connected in electric communication with a display portion 480 and, typically, a joystick or like control interface 485. While the display portion 480 may typically be a screen (e.g., LCD, OLED, etc.) or the like, the system 400 may also use a push button or other input means to indicate and/or input settings or choices. For example, a button may illuminate or pulse green when in operation, red when waiting for confirmation or input, and/or orange when approaching an obstacle. Further, pressing a button in a specific manner may trigger a variety of routines. For example, pressing the button once in a predetermined time period may initiate a first digging/grading sequence, pressing twice may trigger a different sequence, holding down the button may halt operation, etc.

The sensors 465 may be angle sensors, line sensors, accelerometers, inclinometers, gyroscopes, combinations thereof, and/or the like. The sensors 465 may typically be located placed on the blade 25, the chassis 415, and/or the armature members 410, 420, 425, but they may also be attached to any other fixable point of the digging machine and system 400. The chassis sensor 465 may provide may provide the system 400 with a variety of relative motive and orientative data (e.g., relative X and Y coordinates, longitude, latitude, pitch, tilt, yaw, acceleration, humidity, wind speed, etc.). In some implementations, the sensors 465 (e.g., located on the chassis) may also operate in conjunction or in addition to an external, relative positioning component (e.g., a robotic control station and a robotic control station sensor) to provide location and/or motive data. Typically, the sensors have a lag time of less than 0.4 seconds, more typically less than 0.1 seconds, and still more typically less than 0.05 seconds. The boom (first and/or second members 410, 420) is typically valved to 'flex', while precision blade control is executed through cylinder 445. This configuration effectively allows the boom 410, 420 to be partially hydraulically decoupled from the tractor 415 during operation of the stick 425 and blade 25. In this configuration, the movement of the boom member 410, 420 is dampened, insofar as hydraulic fluid is still circulated to and from the boom cylinder 435, but some of the fluid flow is shunted through hydraulic valve 460 (flex hydraulic valve) using one or more bypass 477 and one or more bypass conduits 473. The piston member(s) 435, 440 remain pressurized to support the boom member(s) 410, 420, but the fluidic inputs 481 on either side of piston members 435, 440 are effectively short circuited. The fluidic inputs 481 typically consist of one or more hydraulic ports (e.g., a first hydraulic port, a second hydraulic port, etc.). In some implementations, the fluidic inputs 481 may act as points of ingress and egress for hydraulic fluid—that is, the first hydraulic port may be a fluidic input port and/or a fluidic output port and the second hydraulic port may be a fluidic outlet port and/or a fluidic input port. The weight of the boom 410, 420 in 'flex' status rests on the blade 25, urging the blade 25 downward and allowing digging to be accomplished by control of the stick 425 and the blade 25. Steering is accomplished by controlling the orientation of the blade 25 and providing an urging force to move the blade 25 toward the tractor chassis 415 with the weight of the boom 410, 420 dampening the blade movement. While the urging of the blade 25 may typically be toward the chassis 415, the system 400 may also work in by urging the blade 25 away from the chassis 415. Further, while urging the blade 25 away from the chassis 415, the blade 25 may be oriented as illustrated in FIG. 11, or, alternately, in a reversed position, such that the flat portion (bottom with teeth extending therefrom) 490 of the blade 25 faces away from the chassis 415 as the blade 25 rests on the earth. Steering control may be performed relative to the blade 25, instead of being relative to the tractor 415. In one example of this 'flex' valving operation, as will be described in greater detail later, the system 400 may also disable the upward pivoting (curling, closing) of the blade 25 while maintaining the operability of the downward pivoting (dumping, opening) of the blade 25 by disabling the upward pivot operation of the blade cylinder 445. Such a configuration may, for instance, dampen or eliminate counteracting surges of valving, seen as oscillations or shuddering, of the blade 25. This implementation ('balance') might be thought of as 'dropping to' or 'snapping to' a desired grade.

In some implementations, the system 400 may—in addition to or in substitution of disabling the upward pivot operation of the blade cylinder 445—maintain the upward and downward pivoting ability of the blade cylinder 445. This may, in some instances, allow for quicker and/or more accurate adjustment of the attachment (e.g., blade). This implementation ('dig') might be thought of as 'seeking to' or 'searching to' a desired grade.

The electronic controller 470 is programmed to receive input from the sensors 465 and maintain the flat bottomed blade 25 in a predetermined orientation as it is moved toward the tractor portion 415 as the hydraulic actuators 440, 445 are energized to pivot the members 400, 425 relative to one another. For a horizontal trench, the flat (bottom) portion 490 of the blade 25 is typically maintained in a horizontal orientation and at the desired grade level as the blade 25 is pushed toward the tractor chassis 415. This offers the advantage of gaining efficiency by using more of the available stroke of the stick arm 425 for digging and produces a trench relatively free of crumbs, thus requiring less 'clean up' labor.

With the boom members 410, 420 in 'flex', the boom 410 and stick 425 portions may be actuated to operate like scissors. Actuation of the hydraulic cylinder 440 to push against stick portion 425 causes the angle between stick 425 and boom 420 portions to decrease and blade 25 to move toward tractor portion 415 with dampened boom portion 420 moving upwardly if necessary. As the angle decreases, blade 25 moves toward tractor 415, even if blade 25 must traverse obstacles in the way, such as moving up and over a hill or excavation wall. Increasing or decreasing the flow of hydraulic fluid through the valve 445 and the cylinder(s) 435, 440 operates to vary the effective downward force supplied by the boom member(s) 410, 420 onto the blade 25, effectively increasing or decreasing the weight of the boom 410, 420 as experienced by the blade 25.

The flat blade technique typically partially hydraulically decouples one or both boom members 410, 420 from the hydraulic pump to 'flex' and allows four (4) axes of control to be reduced to only one (1) axis of control, enabling computer control of the excavator, although precise control of the blade 25 may be maintained without the boom 410, 420 in 'flex'. The present novel system 400 employs continuous inputs from at least one sensor 465 operationally connected to the blade 25 and makes corrections to the blade 25 to keep the cutting edge level or otherwise oriented relative to a fixed frame of reference, such as true gyroscopic horizontal. However, any desired orientation of the blade 25 may be selected and maintained, or any predetermined digging profile may be followed. The sensor 465 is typically gyroscopic and is more typically connected to the blade 25.

The system 10 offers the advantages of reducing new operator learning curve, being able to grade out of the operator's line of sight, utilizing the full stroke of the excavator to significantly reducing the need to reposition machine, thus saving significant time and fuel, and allowing the excavator to run by remote control. In addition, the flat blade technique provides the ability to hold and follow grade with the tractor in motion, similar to dozer operation. The present novel system 400 added to the dipper stick allows for complex auto-routines and the operator has the ability to follow sculpted, complex three-dimensional surfaces.

Further, while FIG. 11 illustrates a tractor 415 equipped with three armature members 410, 420, 425 and three hydraulic actuators 435, 440, 445, other embodiments using more or less quantities of armature members and/or actuators may be created. In a first example, a backhoe using two armature members—one boom member (e.g., 410) and one stick member (e.g., 425)—may operationally connect and actuate using a valve 435 and a blade cylinder 425. In a second example, a tractor 415 using four armature members—three boom member (e.g., 410, 420, etc.) and one stick member (e.g., 425)—may operationally connect and actuate using a valve 435, two armature actuators (e.g., 440, etc.), and a blade cylinder 445. In a third example, a tractor 415 using only one boom member—for example, one that extends slideably from the chassis 415—may operationally connect to a blade 25 and actuate using a blade cylinder 425. In a fourth example, the blade 25 may be attached at the underside or side of an armature member (e.g., 410), and the angle of blade may be controlled by actuating a blade piston that is connected to the chassis 415 (instead of an armature member). In another example, a tractor 415 and/or loader may connect directly or semi-directly (e.g., pivotably) to a blade 25 without any intervening armature members 410, 420, 425. The blade 25 may then pivot using a blade cylinder 430 connected thereto and to the tractor 415, and elevation may be controlled by manipulating the chassis 415 itself (e.g., raising the suspension of the chassis 415) and/or the position and angle of the tractor's 415 wheels.

Additionally, the present novel system of control software and valving may enable the system to "see" through the ground and the system keeps the cutting edge of the blade 25 on a predetermined trajectory. The bottom of the blade 25 is controlled to follow a predetermined path through the earth and the cutting edge of the blade 25 is adjusted to follow a desired predetermined surface contour as it is urged through the earth. When combined with a 3-D control system, the blade 25 is able to precisely follow the contours of the predetermined 3-D contour.

In some implementations, the system 400 may also include additional actuators to enable tilting of the attachment (e.g., blade 25) in a diagonal (i.e., roll) fashion. This addition may allow the system 400 to more precisely or more efficiently create, or perform operations on, sloped surfaces. For example, an operator may use such a system 400 with a diagonal tilt to precisely grade a roadside embankment while also maintaining a 40° angle tilt (rolled) orientation. Alternatively, the system 400 may be used to grade a continuous slope for the crown of a roadbed, even when the road is not in a straight line.

Another implementation of the system 400 may allow for precise grading while the tractor 415 is in motion. Because the system 400 allows for 'steering' and grading relative to the blade 25, instead of relative to the tractor 415 (as is currently done), the motion of the tractor 415 is no longer the reference point for a grading system or a grading system operator. The present novel technology allows for the blade 25 to be lowered, aligned to the desired angle, and then, while remaining in that position, pulled through the substrate as the tractor 415 itself moves backward. The result is grading that substantially meets the desired specifications (i.e., fifty-feet-long, flat grade), typically eliminates the need for an additional indicator or spotter, and is vastly more efficient and economical than the traditional method. In another example, the blade 25 may hover just above a substrate (i.e., the operator desires the grade to be at that elevation) and, as the tractor 415 moves forward the blade 25 grades the substrate at an equal and/or predefined grade. Such a configuration may, for instance, be desirable in creating roadbeds, snow beds, and/or obstacles. In effect, this combination with the system 400 may allow a motive backhoe to act like a traditional loader (e.g., skid loaders, track loaders, wheel loaders, frontend loaders, etc.).

As noted above and illustrated by example in FIGS. 1-11, the system 10 may be used in conjunction with more platforms than a backhoe platform. For example, the system 10 may be combined with a loader (e.g., skid loaders, track loaders, frontend loaders, wheel loaders, etc.) to provide more precise and efficient excavation and shaping that might otherwise be accomplished with the platform by itself. This sort of configuration may allow the loader and system 10 combination to act similar to the above-described backhoe in motion.

In some implementations, a loader equipped with the system 10 may grade snow on a surface (e.g., pavement, ski resort, etc.) without damaging the underlying layer of soil and/or pavement as typically occurs with human-operated loaders. Such implementations may also, for instance, be used to shape the snow into elements of greater complexity (e.g., jumps, pipes, etc.) than is presently feasible with a human-operated loader. The substrate, however, may be any substance capable of being loaded or the surface followed by a loader (e.g., soil, rocks, concrete, plant matter, etc.). Thus, for example, a similar system 10 and loader configuration may allow the system 10 to build a motor vehicle track with dirt or like substrates.

By means of general illustration, a blade 25 controlled by any of the above systems may continue to cut grade even if the machine or chassis to which it is connected is moving, pivoting, or otherwise teetering. Movement of the blade 25 is controlled independently of any movement of the tractor, hoe, loader or the like to which the blade 25 is connected. The blade 25 maintains grade even when the tractor 17, 415 and armature 15, 405 are both moving simultaneously and independently of one another.

While the above examples are provided to illustrate multiple individual uses of the system 10, it is understood that these examples may be combined, in whole or in part, with each other as well. For example, all parts of example 1 may be incorporated and/or overlaid upon examples. Further, the above examples illustrate several typical and expected use cases; however, the examples are not intended to limit the system, and the system 10 is not limited to only the above-disclosed examples.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

I claim:

1. A rollered grading assembly, comprising:

an elongated roller drum;

an axle extending through the elongated roller drum;

an elongated housing portion partially enclosing the elongated roller drum and operationally connected to the axle;

an elongated blade portion connected to the elongated housing portion;

a pivot rod disposed perpendicular to the axle and operationally connected to the elongated housing portion;

a coupler operationally connected to the elongated housing portion;

a pivot actuator operationally connected to the coupler and to the elongated housing portion;

wherein the coupler has a proximal end connected to the elongated housing portion and positioned adjacent the elongated roller drum and a spaced distal end extending away from the elongated housing portion;

wherein movement of the distal end a first distance while the proximal end remains stationary urges the elongated housing portion to pivot around the elongated roller drum and move the at least one elongated blade portion a second, shorter distance into a desired position relative grade.

2. The rollered grading assembly of claim 1, wherein first distance is at least twice the second distance.

3. The rollered grading assembly of claim 1, wherein first distance is at least four times the second distance.

4. The rollered grading assembly of claim 1, wherein first distance is at least ten times the second distance.

5. The rollered grading assembly of claim 1, wherein the pivot actuator further comprises at least one hydraulic cylinder operationally connected to the coupler and to the elongated housing portion, wherein the at least one hydraulic cylinder extends generally parallel to the axle.

6. The rollered grading assembly of claim 1 wherein the elongated drum further comprises a first drum portion and a second drum portion, and wherein the axle passes through the first and second drum portions.

7. A rollered grading assembly comprising:

a rollered grading assembly, comprising:

an elongated roller drum;

an axle extending through the elongated roller drum;

an elongated housing portion partially enclosing the elongated roller drum and operationally connected to the axle;

at least one elongated blade portion connected to the elongated housing portion;

a pivot rod disposed perpendicular to the axle and operationally connected to the elongated housing portion;

a coupler operationally connected to the elongated housing portion;

a pivot actuator operationally connected to the coupler and to the elongated housing portion;

a tractor;

at least one boom arm portion extending from the tractor;

a blade arm portion operationally connected to the at least one boom arm portion and operationally connected to the coupler;

a boom hydraulic piston portion operationally connected to the at least one boom arm portion;

a blade hydraulic piston portion operationally connected to the blade arm portion and to the coupler;

a hydraulic fluid source operationally connected to each respective hydraulic piston portion; and a hydraulic valve operationally connected to the boom hydraulic piston portion and to the hydraulic fluid source;

a microprocessor; and a first sensor operationally connected to the elongated housing portion and to the microprocessor;

wherein the coupler has a proximal end connected to the elongated housing portion and positioned adjacent the elongated roller drum and a spaced distal end extending away from the elongated housing portion;

wherein movement of the distal end a first distance while the proximal end remains stationary urges the elongated housing portion to pivot around the elongated roller drum and move the at least one elongated blade portion a second, shorter distance into a desired position relative grade;

wherein the microprocessor is operationally connected to the hydraulic fluid source, to the hydraulic valve, and to each respective hydraulic pistons;

wherein the microprocessor may be engaged to assist movement of the at least one elongated blade portion through a predetermined digging profile;

wherein the microprocessor is operable to:

initialize the digging machine;

calibrate the digging machine;

initialize grading;

monitor grading;

adjust trajectory of the at least one elongated blade portion; and halt grading; and wherein the elongated blade portion maintains grade while the tractor and boom arm are simultaneously and independently moving.

8. The rollered grading assembly of claim 7, wherein the microprocessor is further operable to:

calculate an elevation and an angle of the at least one elongated blade portion to determine a blade position and a blade orientation;

control the at least one elongated blade portion to a predetermined elevation and a predetermined angle;

initialize the hydraulic valve; and actuate the blade hydraulic piston.

9. The rollered grading assembly of claim 7, further comprising:

a second sensor operationally connected to the hydraulic blade arm portion and to the microprocessor; and a third sensor operationally connected to the at least one boom arm portion and to the microprocessor.

10. The rollered grading assembly of claim 7 wherein the elongated drum further comprises a first drum portion and a second drum portion, and wherein the axle passes through the first and second drum portions.

11. A screed assembly, comprising:

an elongated drum assembly;

an elongated housing partially enclosing the elongated roller drum and pivotably connected thereto;

a blade connected to the elongated housing; and a coupler operationally connected to the elongated housing;

wherein the coupler has a proximal end connected to the elongated housing and a spaced distal end;

wherein movement of the distal end a first distance while the proximal end remains stationary urges the elongated housing to pivot around the elongated drum and move the blade a second, shorter distance.

* * * * *